US006769379B2

(12) United States Patent
Foiles

(10) Patent No.: US 6,769,379 B2
(45) Date of Patent: Aug. 3, 2004

(54) BOAT BLIND

(75) Inventor: Jeffery B. Foiles, Kampsville, IL (US)

(73) Assignee: Kolpin Outdoors, Inc., Fox Lake, WI (US)

( * ) Notice: Subject to any disclaimer, the term of this patent is extended or adjusted under 35 U.S.C. 154(b) by 0 days.

(21) Appl. No.: 10/357,263

(22) Filed: Feb. 3, 2003

(65) Prior Publication Data

US 2003/0213424 A1 Nov. 20, 2003

Related U.S. Application Data

(60) Provisional application No. 60/353,140, filed on Feb. 1, 2002.

(51) Int. Cl.[7] ..... B63B 35/00
(52) U.S. Cl. ..... 114/351; 114/361
(58) Field of Search ..... 114/351, 361

(56) References Cited

U.S. PATENT DOCUMENTS 2,689,579 A * 6/1954 Satori ..... 135/133
4,106,145 A 8/1978 Gillen et al.
4,300,253 A 11/1981 Anderson
4,593,641 A 6/1986 Adams et al.
4,671,203 A 6/1987 Sanburg
4,979,456 A 12/1990 Steward
5,458,079 A 10/1995 Matthews et al.
5,615,633 A 4/1997 Cripe
5,887,539 A 3/1999 Rex et al.
2001/0035666 A1 11/2001 Allen

* cited by examiner

*Primary Examiner*—Ed Swinehart
(74) *Attorney, Agent, or Firm*—Brian G. Gilpin; Nicholas D. Doukas; Godfrey & Kahn, S.C.

(57) ABSTRACT

A collapsible hunting blind for use with a vehicle such as a boat has a framework and a cover, where the framework has several parts, including tree-shaped frames with several arms and a vertical post, crossbars, and a lid frame. Each tree-shaped frame is mounted to a crossbar coupled to the vehicle. The cover is attached to the framework and extends over the lid frame to form a lid. Persons traveling in the vehicle are thus concealed when the lid is closed. When the blind is collapsed, each arm folds against the vertical post and the entire tree-shaped frame folds to a side of the vehicle.

15 Claims, 8 Drawing Sheets

BOAT BLIND

CROSS-REFERENCE TO PRIOR APPLICATION

This application is based on and claims priority to U.S. Application Serial No. 60/353,140 filed on Feb. 1, 2002, the disclosure of which is incorporated herein by reference in all its entirety for all purposes.

BACKGROUND OF THE INVENTION

The present invention relates generally to blinds used for hunting. Specifically, this invention relates to a boat supported blind for hunting waterfowl that can be easily folded down for transport to and from a hunting location and readily set up.

Hunters have been pursuing waterfowl, either for food or for sport, for a great many years. Often times, waterfowl are found at locations only accessible by boat. Boats, however do not readily blend into the environment. As such, hunters sitting in boats are easily recognized by waterfowl, and thus avoided by the potential game. Traditionally, successfully hunting waterfowl by boat has involved building hunting blinds at the location and then maneuvering the boat behind the blind. Such blind building is difficult and time consuming. Further, the blind must be rebuilt at every new hunting location. To solve these and other problems inherent in stationary blinds, portable hunting blinds have been developed.

During the past few years, portable hunting blinds have become increasingly popular to waterfowl hunters, especially duck hunters. Many hunters who typically use stationary blinds also own small, flat bottomed boats for transportation to and from hunting locations. Numerous attempts have been made to develop a portable duck blind that may be attached to a conventional boat owned by a hunter, or with which a hunter would likely be familiar.

Hunters typically desire a portable blind that can be easily set up, taken down, and transported to and from the hunting location. In addition, hunters require a full range in which to shoot at waterfowl. Further, hunters desire a relatively inexpensive, readily useable blind that is adaptable for use with a variety of boats.

Some available portable hunting blinds provide an unobstructed opportunity to shoot from horizon to horizon and in all directions. Others are easy to install, easy to collapse, and easy to set up again. Still others are adaptable to many different sized boats. However, no available blind satisfactory fulfills all these criteria. Accordingly, a need exists for an improved portable boat blind that solves these and other deficiencies in the prior art. Of course, the present invention may be used in a multitude of boat situations where similar performance capabilities are required.

SUMMARY OF THE INVENTION

The present invention provides a blind that is cost-effective, easily and securely attached to a boat, provides functionality for the hunter, and which solves the problems raised or not solved by existing designs.

The blind has a framework and a cover. The framework has several parts, including tree-shaped frames having a plurality of arms, a series of crossbars, and a lid frame. Each tree-shaped frame is mounted to a different crossbar. Each crossbar is coupled to the vehicle. Support frames are attached to the arms. The lid frame may be pivotally attached to any of the support frames. The cover is attached to the framework and extends over the lid frame to form a lid. Persons traveling in the vehicle are concealed when the lid is closed.

In one embodiment, at least two of the tree-shaped frames have a vertical post. In another embodiment, the blind is collapsible. In one embodiment, each arm of the tree-shaped frames is pivotally mounted to the vertical posts and each tree-shaped frame is pivotally mounted to a different crossbar. When the blind is collapsed, each arm folds against the vertical post and the entire tree-shaped frame folds to a side of the vehicle.

While one possible application of the present invention is in connection with a boat, many other applications are possible and references to use in connection with a boat should not be deemed to limit the uses of the present invention. The terms "blind," "cover," "frame," "lid," "arm," or "bracket" as used herein should not be interpreted as being limited to specific forms or shapes of a blind, cover, frame, lid, arm, or bracket. Rather, the blind, cover, frame, lid, arm, or bracket may have a wide variety of shapes. These and other objects and advantages of the present invention will become apparent from the detailed description, claims, and accompanying drawings.

DETAILED DESCRIPTION OF THE PREFERRED EMBODIMENTS

Figure 1:
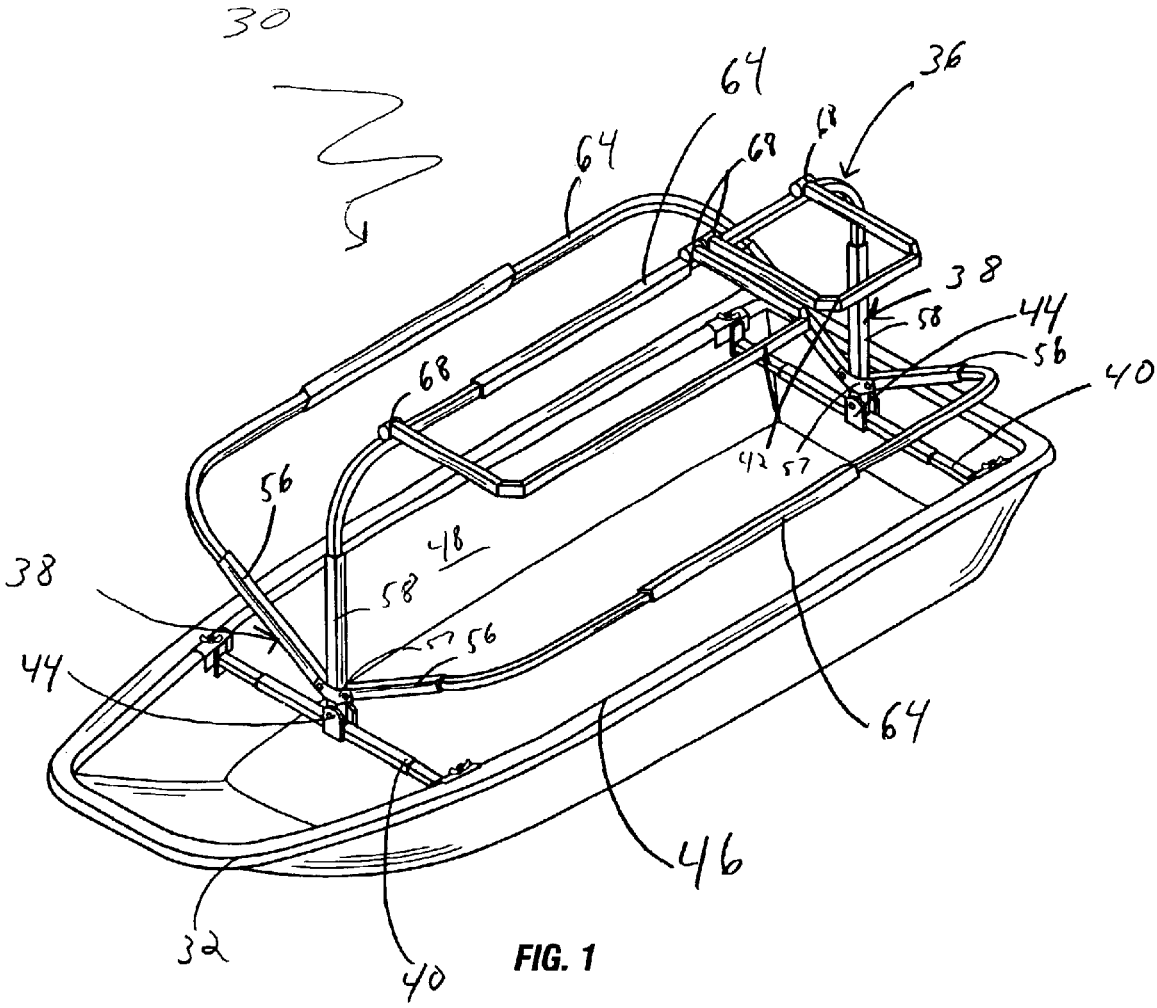
FIG. 1 is a perspective view of a hunting blind in accordance with one embodiment of the present invention, shown attached to a boat and without a cover.

Illustrative embodiments of a boat blind (identified generally as 30) in accordance with the present invention are shown in FIGS. 1 through 13. While the invention may be susceptible to embodiment in different forms, there are shown in the drawings, and herein are described in detail, certain illustrative embodiments with the understanding that the present disclosure is to be considered an exemplification of the principles of the invention, and is not intended to limit the invention to those as illustrated and described herein. Additionally, features illustrated and described with respect to one embodiment could be used in connection with other embodiments.

The blind 30 is for use with a boat 32 of any typical construction. As those familiar with boat-supported duck blinds will recognize, the boat 32 is intended to depict a generic boat commonly used by duck hunters and does not actually depict any particular brand or style of boat. For purposes of this invention, the configuration of the boat 32 is largely irrelevant, as blind 30 is designed to fit on most conventional boats, as explained fully below. In FIGS. 1, 5, and 8 through 13, the blind 30 is shown without cover 34, as can be seen in FIGS. 2 through 4 and 6 and 7, for the sake of clarity. It will also be understood that cover 34 may be removed for purposes of storage, but for convenience will typically remain on the blind 30 throughout an entire hunting season.

The blind 30 includes a framework 36 and a cover 34. The framework 36 is preferably formed of sections of lightweight tubing for reasons of cost and durability, square tubing being one shape found effective. The framework 36 may be formed of lightweight metal such as aluminum, fiberglass, plastic, other composite materials, or the like.

Figure 5:
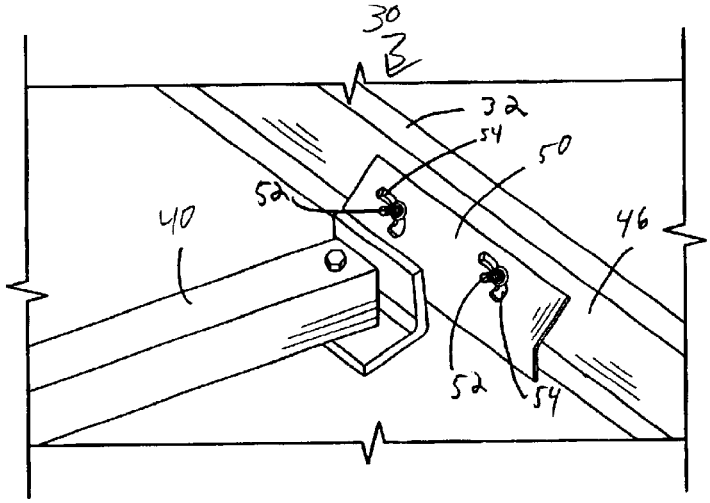
FIG. 5 is a partial perspective view of the bracket attachment of the hunting blind shown in FIG. 1.
Figure 6:
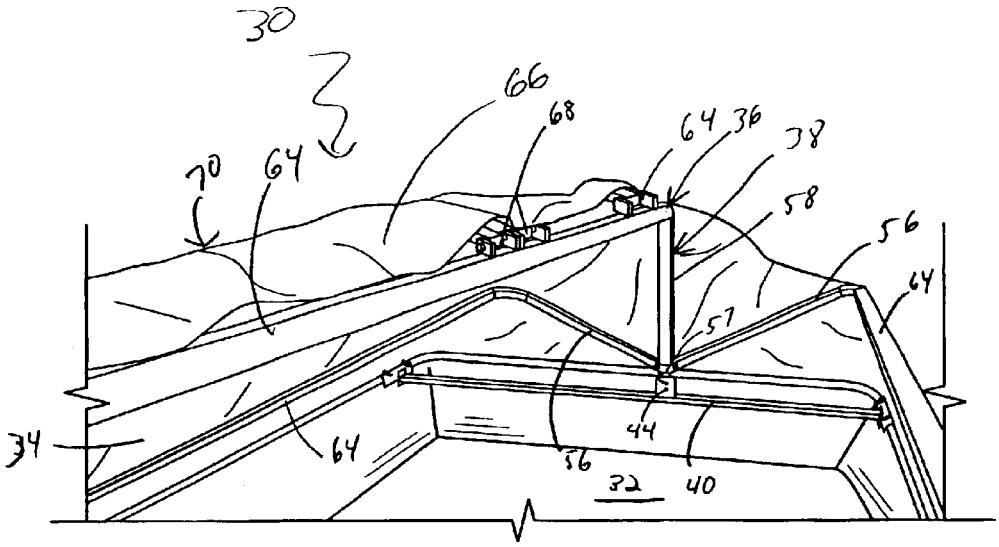
FIG. 6 is a partial perspective view of the hunting blind shown in FIG. 2, shown with the cover partially removed.

The framework 36 includes a plurality of tree-shaped frames 38, a plurality of crossbars 40, and a lid frame 42. Each tree-shaped frame 38 is mounted on a separate crossbar 40. These tree-shaped frames 38 need not be identical. In alternative embodiments, additional frames may be attached to either the crossbars 40, the tree-shaped frames 38, or to the boat itself 32. In one embodiment shown in FIGS. 1, 10, and 13, two substantially identical tree-shaped frames 38 are used to support the cover 34. Each tree-shaped frame 38 may be pivotally mounted to each crossbar 40, or the tree-shaped frame 38 may be in a fixed position. Each tree shaped frame 38 may be mounted to the corresponding crossbar 40 by the use of a bracket 44. Alternatively, each tree-shaped frame 38 and crossbar may be manufactured from a single piece of material by casting, blow molding, injection molding, roto molding or otherwise. Each crossbar 40 is coupled to the boat 32, preferably to the first 46 and second 48 sidewalls. As shown in FIG. 5, such coupling may be accomplished using base plates 50, screws 52, and fasteners 54. Alternatively, the crossbar 40 may be coupled using brackets, C-clamps or the like or the crossbar 40 may be welded, soldered, melted, or otherwise attached to each sidewall or other place on the boat 32. It is to be understood that any form of anchoring each crossbar 40 to a suitably rigid surface of the boat 32 may be used with this invention.

Each tree-shaped frame 38 has a plurality of arms 56. In one embodiment shown in FIGS. 1, 9, and 10, each tree-shaped frame 38 has a central vertical post 58. The vertical post 58 may be pivotally attached, hingedly engaged, or permanently fixed to the bracket 44. One manner of pivotally attaching the vertical post 58 is by the use of a first pin 60. The vertical post 58 may then be locked into a vertical position by a second pin 62. It is to be understood that the vertical post 58 maybe attached to the bracket 44 and locked into the vertical position using any conventional means.

Figure 9:
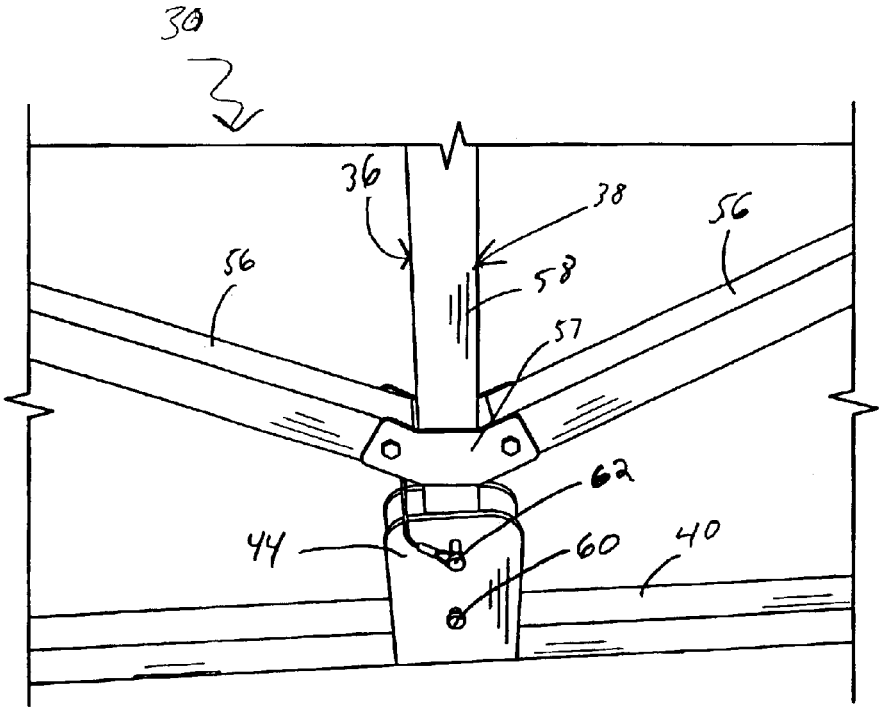
FIG. 9 is a perspective view of a portion of the framework of the hunting blind shown in FIG. 1.
Figure 10:
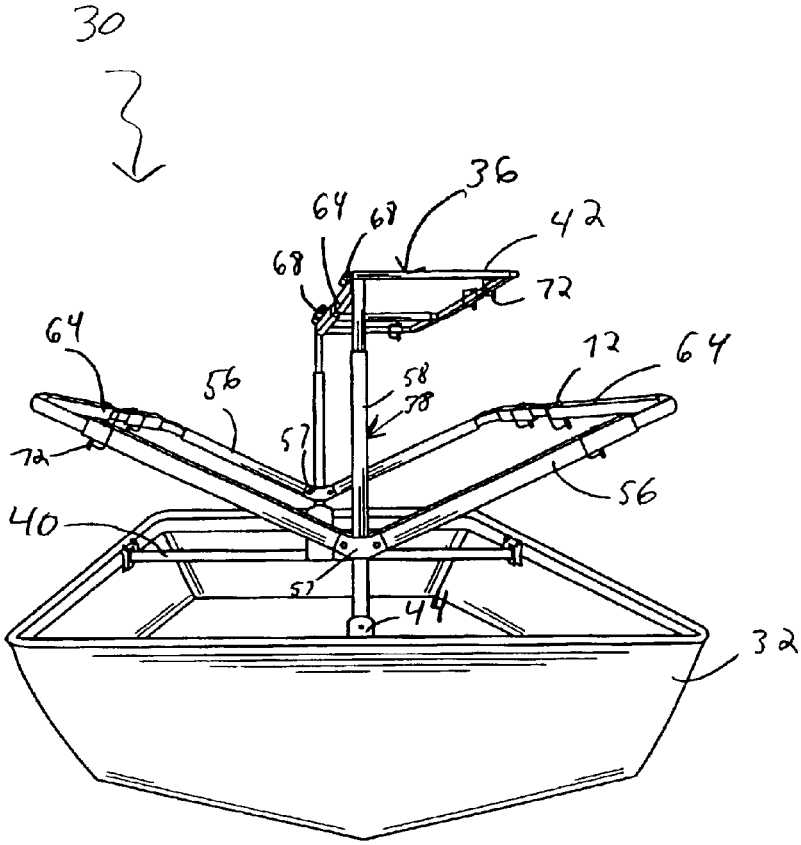
FIG. 10 is a perspective view of the hunting blind shown in FIG. 1, shown without the cover.
Figure 13:
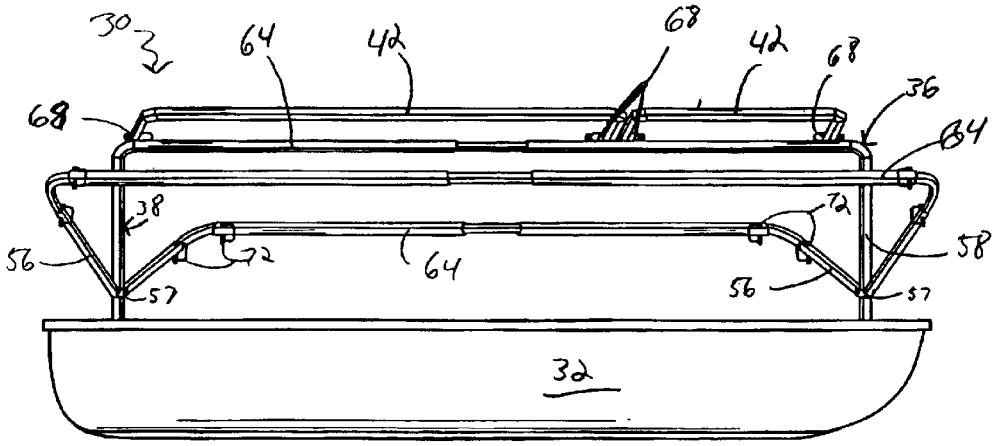

As shown in FIGS. 1, 9, and 10, the arms 56 of the tree-shaped frames 38 may be hingedly connected or pivotally mounted to the vertical post 58. The specific tree-shaped frames 38 employed in any given embodiment need not have the same number of arms 56. As shown in FIGS. 1, 10, and 13, the arms 56 are angled upwardly when the blind 30 is set up. The arms 56 are folded against the vertical post 58 when the blind 30 is collapsed. In the embodiment shown in FIGS. 1, 9, and 10, one arm 56 is mounted on either side of the vertical post 58 of each tree-shaped frame 38. In one embodiment shown in FIGS. 1 and 9, each arm 56 pivotally engages a bracket 57 attached to the vertical post 58.

As shown in FIGS. 1, 10, and 13, the framework 36 also includes a plurality of support frames 64. The support frames 64 may have a variety of forms, including without limitation U-shaped, tee-pee shaped, A-shaped, and dome shaped. A support frame 64 is coupled to the free ends of at least two arms 56 and the vertical posts 58 of at least two tree-shaped frames 38, respectively. Depending on the embodiment, the support frames 64 may be coupled to every arm 56 of at least two of the tree-shaped frames 38, or coupled to every arm 56 of every tree-shaped frame 38 employed. In the embodiment shown in FIGS. 1, 10, and 13, a support frame 64 is coupled to both arms 56 and the vertical posts 58 of both tree-shaped frames 38.

Figure 2:
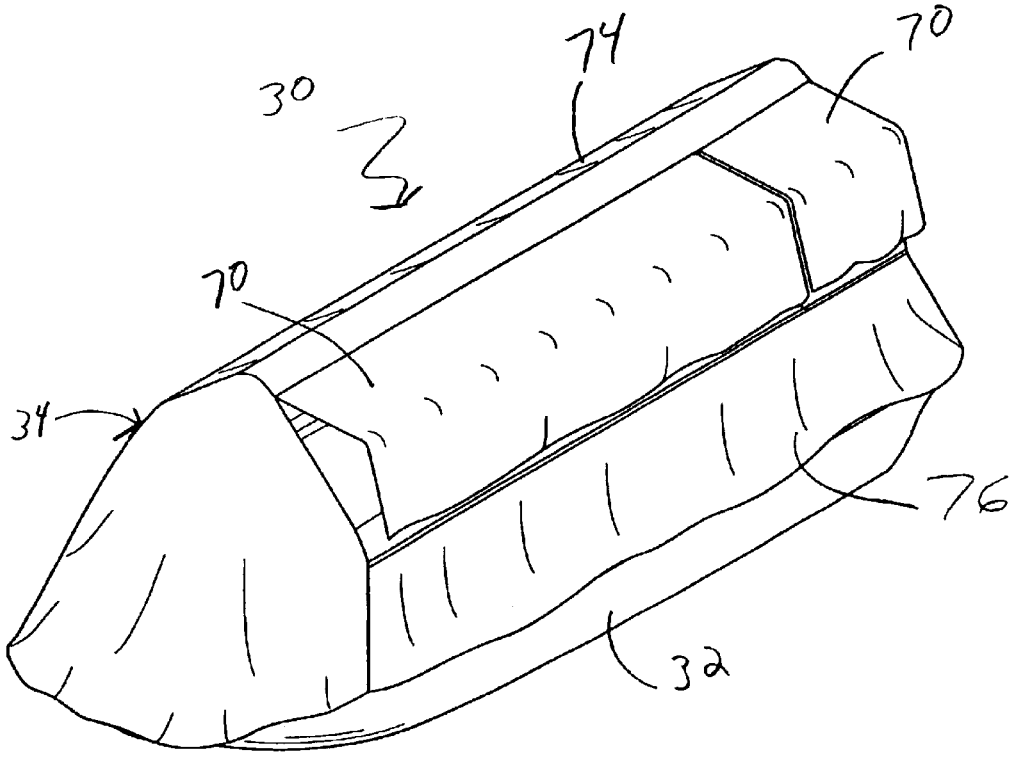
FIG. 2 is a perspective view of the hunting blind shown in FIG. 1, shown with a cover.
Figure 3:
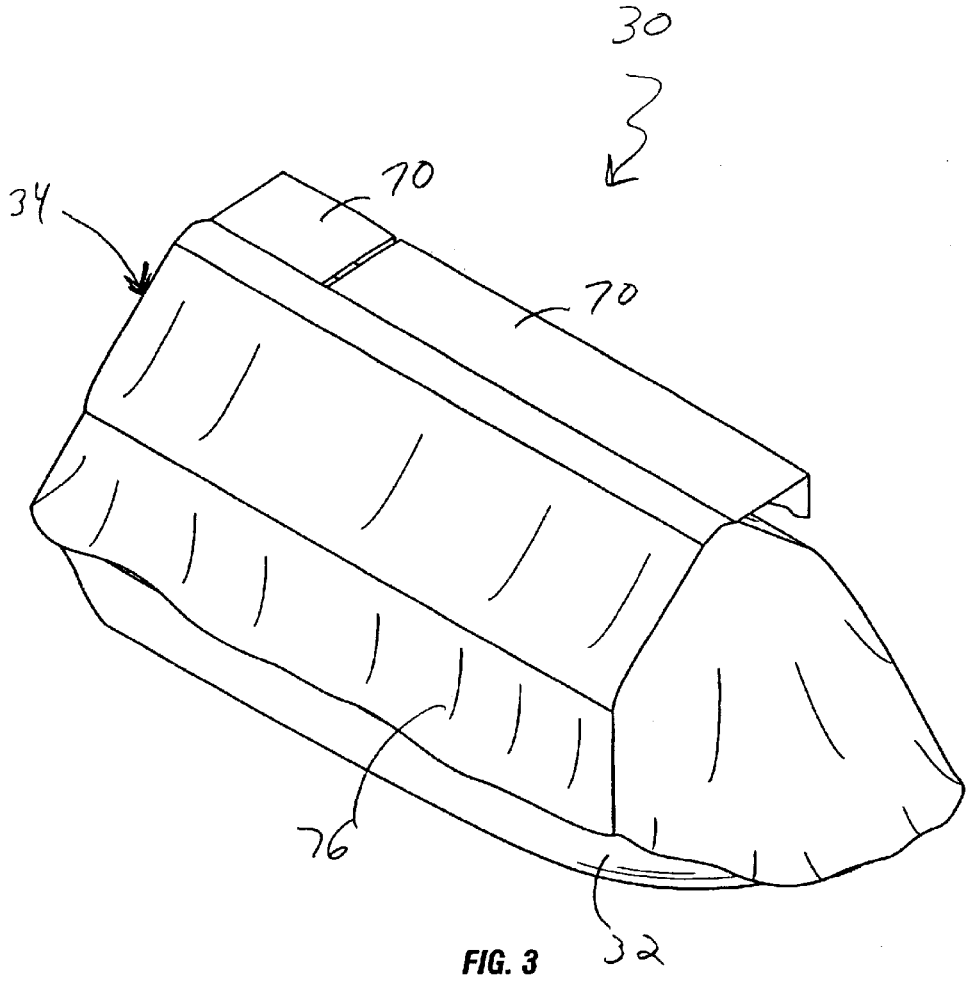
FIG. 3 is an opposite side perspective view of the hunting blind of FIG. 2.
Figure 4:
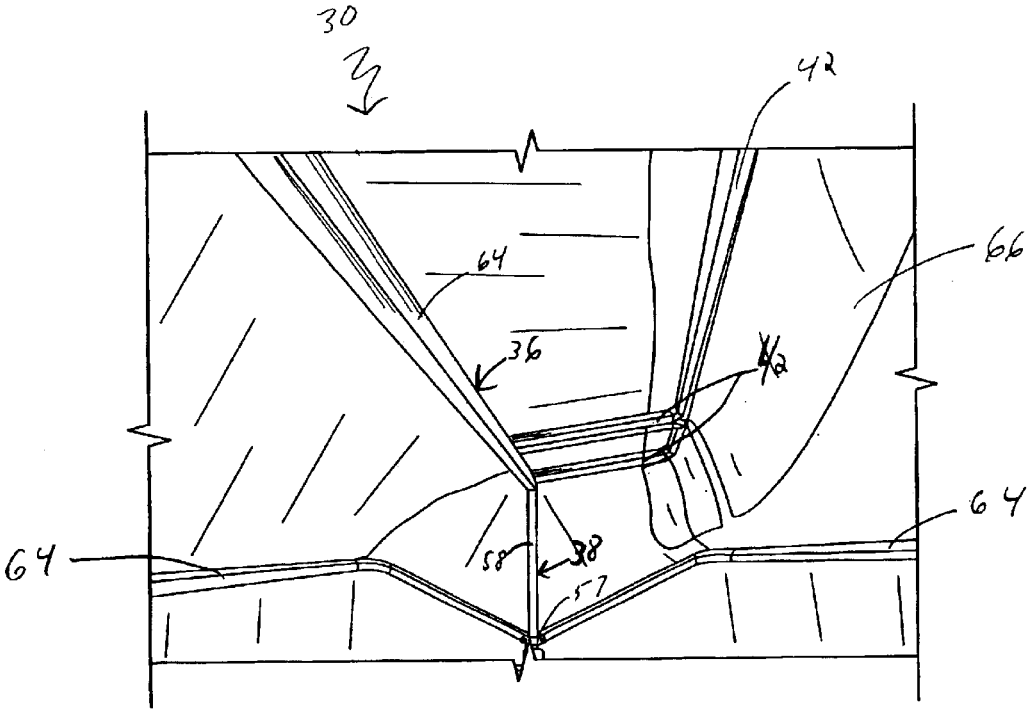
FIG. 4 is a partial perspective interior view of the hunting blind shown in FIG. 2.

As shown in FIGS. 1, 2, and 3, the framework 36 also includes a lid frame 42. The lid frame 42 may be a single piece, or it may be divided into any number of sections. As shown in FIGS. 1, 2, and 3, one of the sections of the lid frame 42 may be smaller to accommodate a single hunter. Such ability is useful to allow a person using a duck call to scan the hunting location, while the other hunters remain hidden under the balance of the lid 70. As shown in FIG. 3, a drape 66, preferably partially or wholly formed of netting, may depend from the lid frame 42 or cover 34 so as to screen hunters in the blind 30 from view when the lid frame 42 is open. The drape 66 may have a camouflage pattern.

Figure 7:
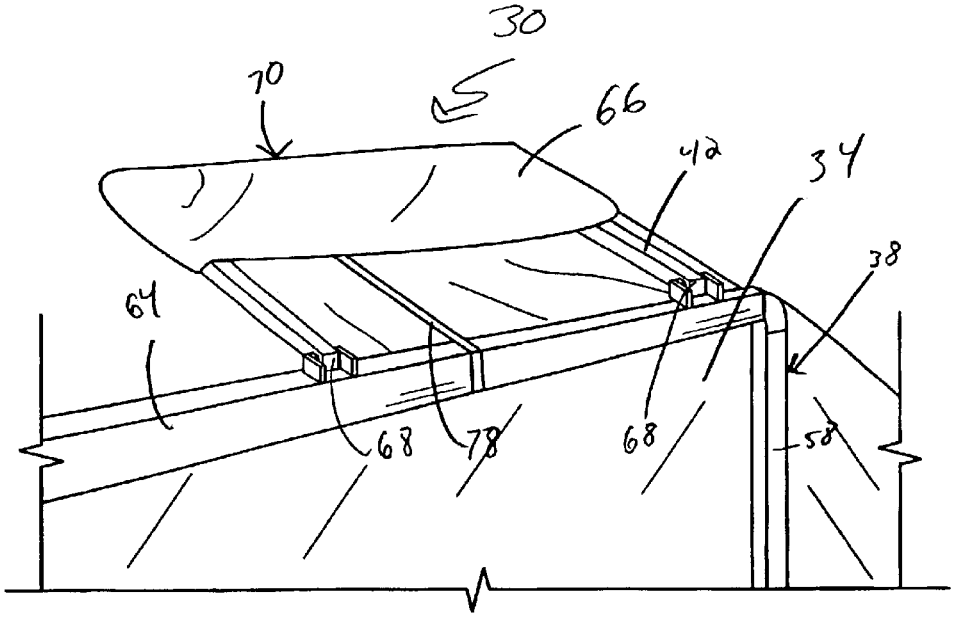
FIG. 7 is a partial perspective view of the hunting blind shown in FIG. 2, shown with the cover partially raised.
Figure 8:
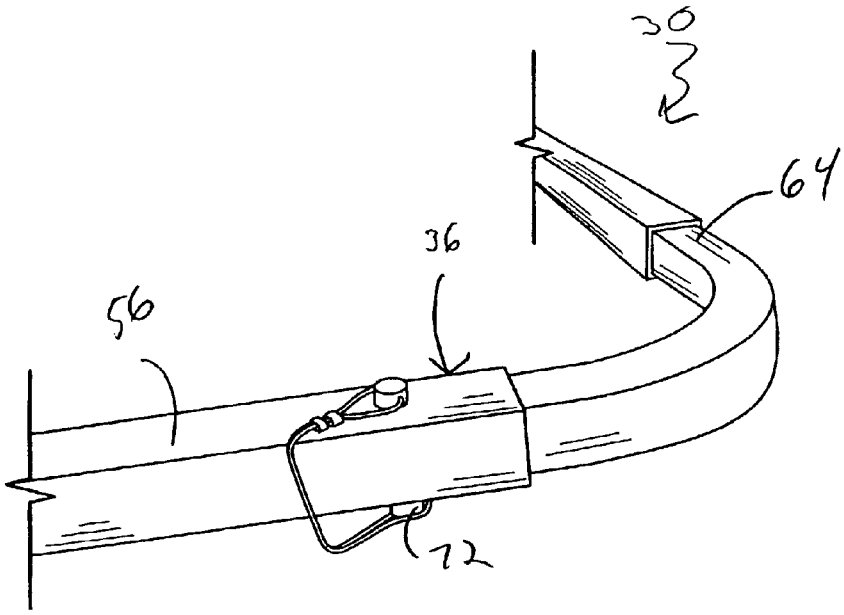
FIG. 8 is a perspective view of a portion of the framework of the hunting blind shown in FIG. 1.
Figure 11:
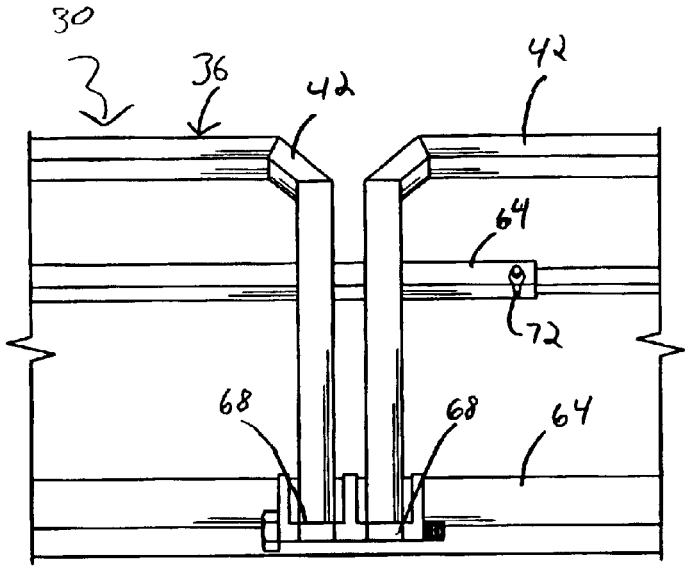
FIG. 11 s a partial top perspective view of a portion of the framework of the hunting blind shown in FIG. 1.
Figure 12:
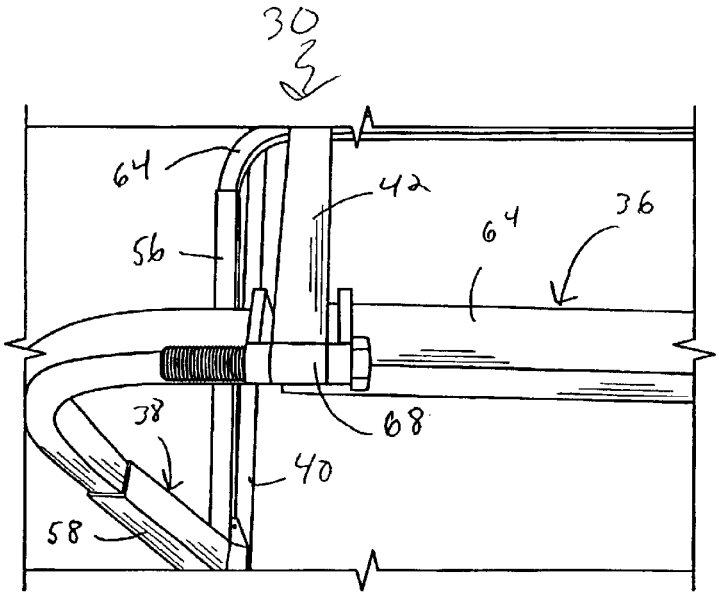
FIG. 12 is a partial top perspective view of a portion of the framework of the hunting blind shown in FIG. 1; and, FIG. 13 is side view of the hunting blind shown in FIG. 1.

The lid frame 42 may be pivotally engaged to any support frame 64. In one embodiment shown in FIGS. 11 and 12, the lid frame 42 pivotally engages a support frame 64 via brackets 68. Alternatively, the lid frame 42 may engage a support frame 64 via bearings, mounts, bolts, or the like. As shown in FIGS. 7, 11, and 12, the lid frame 42 may pivotally engage a support frame 64 so that the lid frame 42 may be stopped and secured at any number of positions, including without limitation fully open, halfway open, and full closed.

When the lid frame 42 pivotally engages a support frame 64 coupled to an arm 56, the lid frame 42 may open up or down. When the lid frame 42 pivotally engages the support frame 64 coupled to the vertical post 58, as shown in FIG. 1, the lid frame 42 opens up. As shown in FIGS. 2, 3, 6, and 7, the lid frame 42 may be covered with a portion of the cover 34 to form a lid 70. The cover 34 may be draped over the lid 70. Alternatively, the cover 34 may be securely attached to the lid frame 42 by channel stitching, ties, velcro, snaps, or the like. The lid 70 may be secured in the closed position by ties, velcro, snaps, or the like. The lid 70 or the lid frame 42 may have a handle 78, rope, or other feature to facilitate opening and closing the lid 70 and/or the lid frame 42.

As shown in FIGS. 1, 8, 10, and 13, for use with different sized and styles of boats 32, the tree-shaped frames 38, vertical posts 58, arms 56, crossbars 40, support frames 64, and/or the lid frame 42 may be formed of telescoping sections. Suitable detents 72, as will be apparent to one skilled in the art, may be provided for locking the various components of the framework at appropriate lengths. Those skilled in the art will appreciate the fact that the blind 30 is, by virtue of the above-described components, fully adjustable in both length and width to accommodate most common boats 32.

The cover 34 has a rear wall 74 and a front wall 76. The rear wall 74 is attached to the support frame 64 coupled to the vertical post 58 and at least one support frame 64 coupled to at least one arm 56. A front wall 76 of the cover 34 is attached to at least one other support frame 64. In the embodiment shown in FIGS. 2 and 3, the cover 34 is attached to the support frame 64 opposite the support frame 64 attached to the rear wall 74. The rear wall 74 and front wall 76 may be attached to each support frame 64 by channel stitching, ties, Velcro, snaps, or the like. As shown in FIGS. 2 and 3, the front 76 and rear 74 walls extend around the tree-shaped frames 36 with sufficient material to cover the ends of the boat 32. The front 76 and rear 74 walls may be joined in any conventional way or overlapped.

The cover 34 may be formed of a cloth or canvas like material such as nylon, canvas, corduroy, burlap, or cloth. The cover 34 may also be formed from woven or nonwoven mesh material. This material may be flame and/or fire retardant, waterproof or water-resistant and may have insulating properties. A camouflage pattern may be provided on the cover 34. The cover 34 may also provide for pockets or straps on the exterior surface. The pockets or straps are used to secure vegetation or synthetic camouflaging material or items to the blind 30, thereby improving its ability to blend in with the background. The cover 34 may have doors that allow hunters, dogs, or other animals to easily enter and exit the boat 32 when the blind 30 is erected. The cover 34 may also have any number of pockets to store hunting, camping, and other outdoor equipment. The cover 34 may also be partially formed of mesh material or otherwise ventilated. Further, the cover 34 may be partially translucent or transparent, allowing hunters inside the blind 30 to scan their surrounding without opening the blind 30. The cover 34 may have peepholes, mesh portions, or other features to accomplish the same. The cover 34 may also have any number of flapped openings or holes through which hunters may shoot at prey without having to fully open the blind 30.

In addition, this invention also allows for a number of accessories to be attached either to the cover 34 or to the framework 36. Such accessories include dog ramps, decoy retrieval devices, nets, and the like.

It will be recognized that the blind 30 can be assembled while at dockside or even when the boat 32 remains on a trailer prior to being launched. In use, the blind 30 is easily installed on the boat 32 and collapsed such that the boat 32 may be transported to a hunting location. Upon arriving at the location, the blind 32 may be easily set up by raising the vertical posts 58 and arms 56 of each of the tree-shaped frames 38. At the beginning of a hunt the lid 70 is closed and the hunters are hidden within the blind 30. When a shooting opportunity arises, a hunter stands up quickly. Depending on how the lid 70 is attached to the framework 36, the hunter then flips the lid 70 open by either pushing the lid 70 up or down. The hunter then has the opportunity to shoot. In the embodiment shown in FIGS. 1 through 13, the hunter has a full view and opportunity to shoot from horizon to horizon in any direction without interference by the blind 30.

The blind 30 of the present invention may have other applications aside from use in connection with vehicles such as boats 32. Although the invention has been herein shown and described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims.

I claim:

1. A hunting blind for a vehicle comprising:

a framework formed from a plurality of crossbars, a plurality of tree-shaped frames, a plurality of support frames, and a lid frame, wherein the lid frame has at least one section, wherein each of the plurality of tree-shaped frames includes a plurality of attached arms and is mounted to one of the plurality of crossbars, wherein each of the plurality of support frames is coupled to at least two of the attached arms, and wherein the lid frame is pivotally attached to one of the plurality of support frames.

2. The hunting blind of claim 1 further comprising a cover having a front wall and a rear wall attached to the framework, wherein at least a portion of the cover extends over the lid frame so as to conceal an interior portion of the vehicle when the lid frame is placed in a closed position.

3. The hunting blind of claim 2 further comprising a drape attached to the lid.

4. The hunting blind of claim 2 where the framework is formed of telescoping sections.

5. The hunting blind of claim 2 where the lid frame pivotally attaches to one of the plurality of support frames so as to be selectively stoppable in at least one position.

6. The hunting blind of claim 2 where the plurality of support frames have a U shape.

7. The hunting blind of claim 2 where at least two of the plurality of tree-shaped frames have vertical posts to which a plurality of arms attach.

8. The hunting blind of claim 7 where the lid frame is pivotally attached to one of the plurality of support frames coupled to the vertical posts.

9. The hunting blind of claim 7 where the rear wall of the cover is attached to one of the plurality of support frames coupled to the vertical posts.

10. The hunting blind of claim 9 where the front wall of the cover is attached to one of the plurality of support frames that is not attached to the rear wall.

11. The hunting blind of claim 7 where the framework is collapsible.

12. The hunting blind of claim 11 where at least two of the plurality of tree-shaped frames are pivotally mounted to different crossbars.

13. The hunting blind of claim 12 where each of the plurality of attached arm is pivotally mounted to the vertical post such that the arms may be folded against the vertical post when the hunting blind is moved to a collapsed position.

14. A hunting blind for use with a boat, the hunting blind comprising;

a plurality of crossbars, each of the plurality of crossbars adapted to be coupled to the boat;

a plurality of tree-shaped frames, each of the plurality of tree-shaped frames pivotally mounted to one of the plurality of crossbars, where each tree-shaped frame includes a vertical post and a plurality of arms pivotally attached to the vertical post such that the arms are foldable against the vertical post when the hunting blind is positioned in a collapsed position;

a plurality of support frames coupled to each of the plurality of arms and to each vertical post;

a lid frame having at least one section, where the lid frame is pivotally attached to one of the plurality of support frames; and a cover having a front wall attached to one of the plurality of support frames and a rear wall attached to one of the plurality of support frames, where a portion of the cover extends over the lid frame.

15. A hunting blind for use with a boat, the hunting blind comprising;

a plurality of crossbars adapted to be securely positioned within the boat;

a plurality of tree-shaped frames, each of the plurality of tree-shaped frames pivotally mounted to one of the plurality of crossbars, each of the plurality of tree-shapes frames having a vertical post and a plurality of arms pivotally attached to the vertical post such that the arms are selectively foldable against the vertical post;

a plurality of U-shaped support frames coupled to each of the plurality of arms and to each of the vertical posts of each tree-shaped frame;

a lid frame pivotally attached to at least one of the plurality of U-shaped support frames; and a cover having a rear wall attached to one of the plurality of U-shaped support frames and having a front wall attached to another of the plurality of U-shaped support frames, at least a portion of the cover extending over the lid frame.

* * * * *